United States Patent [19]

Sudnishnikov et al.

[11] 4,214,638

[45] Jul. 29, 1980

[54] METHOD OF CONTROLLING THE REVERSING OF A DEVICE FOR DRIVING HOLES IN EARTH AND DEVICE FOR PERFORMING SAME

[76] Inventors: Boris V. Sudnishnikov, Krasny prospekt, 56, kv. 59; Khaim B. Tkach, ulitsa Gogolya, 17, kv. 49; Alexandr D. Kostylev, ulitsa Derzhavina, 19, kv.44; Veniamin V. Kamensky, ulitsa Derzhavina, 19, kv. 70; Konstantin K. Tupitsyn, Krasny prospekt, 51, korpus 3, kv. 25; Vladimir M. Terin, Gusinobrodskoe shosse, 19, kv. 10, all of Novosibirsk, U.S.S.R.

[21] Appl. No.: 878,414

[22] Filed: Feb. 16, 1978

[51] Int. Cl.[2] ..... B25D 9/00

[52] U.S. Cl. ..... 173/1; 173/91

[58] Field of Search ..... 91/33; 173/1, 91, 137, 173/138; 175/19

[56] References Cited

U.S. PATENT DOCUMENTS

| | | | |
|---|---|---|---|
| 3,705,633 | 12/1972 | Sudnishnikov et al. | 173/91 |
| 3,727,701 | 4/1973 | Sudnishnikov et al. | 173/91 |
| 3,744,576 | 7/1973 | Sudnishnikov et al. | 173/91 |
| 3,756,328 | 9/1973 | Sudnishnikov et al. | 173/91 |
| 4,078,619 | 3/1978 | Sudnishnikov et al. | 173/91 X |

*Primary Examiner*—Lawrence J. Staab

*Attorney, Agent, or Firm*—Robert E. Burns; Emmanuel J. Lobato; Bruce L. Adams

[57] ABSTRACT

A percussive device operable in a forward mode for making a hole in soil and operable in a reverse mode to retract the device from the hole. The device is provided with control means that change the mode of operation alternatively under control of a valve that turns air pressure on and off in a supply or feed line to the device. When the air is turned off from the device the valve establishes connection to an aspirator for establishing a suction condition to the device that will reverse the mode so that upon turning on of air back to the device will make it operate in the changed-over mode.

3 Claims, 6 Drawing Figures

METHOD OF CONTROLLING THE REVERSING OF A DEVICE FOR DRIVING HOLES IN EARTH AND DEVICE FOR PERFORMING SAME

BACKGROUND OF THE INVENTION

The present invention relates to construction technology, and, more particularly, it relates to a method of controlling the reversing of a device for driving holes in the earth and to devices for performing same.

The invention can be used to utmost effectiveness for driving or making holes in compacted soil.

The present invention can be also used to advantage in driving pipes and tubes into the soil, e.g. at trenchless laying of underground lines.

At present, various holes are driven in the earth with a wide use of devices actuated by a pressurized fluid, e.g. compressed air. More often than not the devices used are reversible, i.e. they can be operated in the forward mode wherein they advance through the soil and make a hole therein, as well as in the reverse mode, so that they can be retracted from the soil the back to surface.

There are also known methods of controlling the reversing of such percussive devices for driving or sinking holes in the earth, based on the air supply line being rotated. By rotating this line in either direction, a member controlling the air distribution in the device for driving holes in earth is, respectively, turned either in or out in a thread between two extreme positions. This operation results in the direction of the impacts in the percussive-action device being reversed, which is tantamount to reversing the direction of the progress of the device for driving holes in the earth.

This method is embodied in a percussive device for driving holes in earth (see, for example, the USSR Inventor's Certificate No. 238,424) comprising a cylindrical housing with a pointed forward end. The housing accomodates therein a reciprocable impact member having a hollow space in the rear portion thereof. The space receives therein a stepped-diameter tubular part secured in the housing by a threaded connection. The tubular part is movable between two positions whereat, respectively, the device is advanced in the forward and reverse directions.

Connected to the rear or tail portion of the tubular part is a compressed-air supply hose. The impact member is arranged in the housing so that its external surface defines with the internal surface of the housing the front working chamber, while the internal surface of the hollow space in the tail portion of the impact member defines with the tubular part the rear working chamber. The impact member has made therein a port adapted to establish communication between the two chambers, to effect reciprocation of the impact member, the chambers being communicated when the impact member is in the front part of the housing.

This hitherto known percussive device for driving holes in earth operates with compressed air being supplied via the hose and the tubular part into the rear chamber, whereby the impact member is driven forward and delivers an impact upon the front part of the housing at the end of its forward stroke. At this moment compressed air is supplied through the port in the impact member into the front working chamber.

The effective end face area of the impact member, acted upon by compressed air in the front chamber, being greater than the effective end face area of the same impact member, acted upon by compressed air in the rear chamber, the force urging the impact member in the rearward direction is greater than the force urging the impact member in the forward direction. Consequently, the impact member is driven rearwardly. Upon the port of the impact member clearing the rearmost end edge of the tubular part, compressed air is exhausted from the front chamber into ambient air.

Now the pressure of compressed air in the front chamber becomes short of the pressure in the rear chamber, the last-mentioned pressure equalling the supply line pressure, whereby the impact member is arrested and then driven forward once again, through its forward stroke.

Then the abovedescribed cycle of the operation of the device of the prior art in the forward mode repeats itself.

To make the device for driving holes in earth operate in the reverse mode, the tubular part is to be set to the position corresponding to the reverse operation. This is done by rotating the tubular part with aid of the supply hose connected thereto, until this tubular part is set at its rearmost position.

Now compressed air is again supplied into the rear chamber and also periodically supplied through the port in the impact member into the front working chamber, driving the impact member through successive reciprocations. However, in this case the impact member delivers impacts upon the rear or tail part of the housing, in which way the device is retracted through the hole made in the course of the operation of the device in the forward mode.

A disadvantage of this technique of controlling the device for driving holes in earth arises from the fact that after the hole has been made to a considerable length, it is difficult and in certain cases altogether impossible to transmit the controlling torque to the tubular part with aid of the supply hose. Moreover, this manner of switching the device from one mode of operation to the other one has proved to be time-consuming.

There is also known a method of controlling the reversing of a percussive action device for driving holes in the earth, based on pulling a cable and then rotating the supply hose to displace an air-distributing member, in which way the advance of the device is reversed.

This method of controlling a percussive device for driving holes in the ground is performed by a device (see the West German Pat. No. 2,340,751) comprising a cylindrical housing accomodating therein a reciprocable impact member. The impact member has a hollow space in its tail portion, receiving a tubular part secured in the housing. The external walls of the impact member define with the internal wall of the housing the front working chamber, while the walls of the hollow space in the impact member define with the end face of the tubular part the rear working chamber. The two chambers communicate via a port made in the impact member.

The tubular part has two annular lugs with two longitudinal lugs therebetween, limiting the displacement of this part in the axial direction, and also two recesses preventing rotation of this part relative to the housing. The tubular part is mounted in the axial bore of a guide element secured in the housing and having two longitudinal grooves and an aperture receiving a spring-urged retaining element connected with the remote-control cable. The abutment of the retaining element in the tubular part-retaining position projects into the recess in the body of the tubular part. Longitudinal grooves are made in the wall of the axial bore of the guide element. The annular and longitudinal lugs retain the tubular part in either one of two positions corresponding to the forward and reverse mode of the operation of the device for driving holes in ground.

In the forward mode of the operation of the last-described device of the prior art the tubular member is positioned so that the pattern of air distribution in the device provides for practically simultaneous impact of the impact member upon the foremost portion of the housing and admission of compressed air into the front working chamber. In this mode of operation the impact member is reciprocated, delivering successive impacts upon the foremost portion of the housing. Should it be necessary to reverse the device for driving holes in the ground, the tubular part is to be set to the other extreme position. This is attained by manually pulling the retaining element remote control cable, to withdraw the retaining abutment from the recess in the tubular part. Then the supply hose is rotated to rotate the tubular part with respect of the guide element, until its longitudinal lugs align with the grooves of the guide element. Under the action of the air pressure in the rear chamber, the tubular part is now displaced rearwardly of the device, into its other position. To retain the tubular part in this new position, the hose is rotated to rotate the tubular part about the latter's axis, and the cable is released for the retaining element to engage the tubular part.

In this new position it is ensured that the admission of compressed air into the front working chamber takes place earlier than in the forward mode, while the exhaust takes place relatively later, whereby the impact member now delivers impacts upon the rear portion of the device, which means that the device for driving holes in the ground is now advanced in the reverse direction.

A disadvantage of this reversing control method is the very incorporation of the cable which is apt to get tangled with the supply hose, or else to get caught by some foreign object. Moreover, the rotation of the hose is still required to reverse the device, which is difficult when the hole is relatively long.

There is further known a method of controlling the reversing of a percussive device for driving holes in ground, wherein the reversing control function is effected by cutting off and re-establishing the supply of compressed air through the feed line. In this way action is exerted onto an element controlling the direction of the progress of the device.

This reversing control method is performed by a percussive device for driving holes in earth (see the West German Auslegeschrift No. 2,105,229) comprising a cylindrical housing accomodating therein a reciprocable impact member. The impact member has a hollow space in the rear or tail portion thereof, receiving therein a tubular part secured in the housing. The external walls of the impact member define with the internal walls of the housing the front working chamber, while the walls of the hollow space of the impact member and the front end face of the tubular member define the rear working chamber. The impact member has a port made therein through which the two chambers communicate with each other to effect reciprocation of the impact member. A specific feature of the construction of the device is the incorporation of a bushing rotatable relative to the tubular member. The rotation of the bushing relative to the tubular part is provided for by the tubular part having made therein a cam groove, and the bush having a lug received in this groove.

The tubular part has in the greater-diameter portion thereof two rows of ports, while the bushing has on the greater diameter portion thereof two rows of slots, so arranged that when the bushing is rotated relative to the tubular part, it has its wall closing one row of the ports in the tubular member and opening up the other row. When the device for driving holes in the ground is to be operated in the forward mode, those ports of the tubular member are closed, which are the nearest to the front portion of the housing, and those ports are open which pertain to the tail portion of the housing. In this situation compressed air is supplied into the front working chamber upon the ports of the impact member having cleared the foremost edge of the tubular part, and the exhaust is effected through the open ports of the tubular part.

When compressed air is supplied via the hose and the tubular part into the rear working chamber, the impact member is driven toward the front portion of the housing, and in its foremost position it delivers an impact upon the housing. At this moment compressed air is admitted from the rear working chamber into the front working chamber via the ports in the impact member. Owing to the pressure differential acting upon the impact member, with the effort applied thereto from the front chamber being greater than from the rear one, the impact member commences its rearward motion. Upon the ports of the impact member aligning with the ports of the tubular part, compressed air is exhausted from the front working chamber into the ambient air.

To switch over the last-described device for driving holes in earth from forward to reverse operation, the supply of compressed air thereto is to be cut off. A spring then displaces the bushing relative to the tubular part, and, owing to the action of the cam slot, the bushing is rotated relative to the tubular part. When the compressed air supply is re-established, the bushing rotates some more relative to the tubular part. Now the ports of the tubular part, which are closer to the front portion of the housing, become open, and the rearmost ports therein are closed.

Now, when compressed air is supplied into the rear working chamber, the admission of compressed air into the front working chamber takes place earlier than at the forward mode of operation, whereas, in its turn, the exhaust is delayed, whereby the reciprocating impact member delivers impacts upon the rear or tail portion of the device.

A shortcoming of the last-described techinque of reversing the operation of a device for driving holes in the ground is that operating the device becomes hampered when either the air supply thereto is incidentally cut off, or else when the operation is to be interrupted for some reason, which involves cutting off the compressed air supply, because in both cases the mode of operation of the device is reversed, which is quite uncalled for. This becomes particularly awkward when the device is launched into earth, and the supply of compressed air is to be repeatedly turned off and on to correct the hole-making direction.

SUMMARY OF THE INVENTION

It is an object of the present invention to eliminate the disadvantages and shortcomings of the reversible devices for driving holes in earth, which have been described hereinabove.

It is another object of the present invention to increase the capacity of the device.

It is still another object of the present invention to improve the reliability of the control, when the operation of the device is to be reversed.

These and other objects are attained in a method of reversing pneumatic reversible percussive devices for making holes in the ground, wherein, to reverse the operation of a device from the forward mode in which a hole is being made to the reverse mode in which the device is retracted from the hole, and also to re-reverse the operation from the reverse mode to the forward mode, the supply of compressed air along the feed line to the device is cut off, and after reversing the device the supply is re-established, in which method, in accordance with the present invention, following the cutting-off of the supply of compressed air, suction is created in the air feed line, in which manner the reversing of the device is effected.

This pattern of controlling the reversing of a percussive device for driving holes in the ground from one mode to the other one, e.g from the forward mode to the reverse one, provides for reliable remote control of such reversing.

The herein disclosed method can be performed by a pneumatic reversible percussive device for driving holes in earth, comprising a hollow housing accomodating therein a reciprocable impact member defining a rear working chamber and also defining with the housing a front working chamber, the impact member being reciprocable in operation of the device under the action of compressed air supplied into said working chambers via a stepped-diameter air supply bush received in the rear working chamber of the impact member and secured in the tail portion of the housing, the bushing having in its greater-diameter stage, cooperating with the impact member, ports closeable with a spring-urged hollow valve element received within the air supply bushing and having in its surface cooperating with the air supply bush other ports alternatingly aligning with and closing off the corresponding ones of the ports in the bushing upon the hollow valve element being rotated about the longitudinal axis thereof, which rotation is effected owing to the internal surface of the air supply bushing and the external surface of the valve element both having made therein a rotating zigzagshaped groove movably receiving therein a lug, in which device, in accordance with the present invention, the hollow valve element is accomodated within the greater-diameter stage of the air supply bushing, its end face facing the smaller-diameter stage of the air supply bushing having made therein apertures associated with valves, the air feed line through which compressed air supplied to the device incorporating an aspirator.

It is expedient that the aspirator should include an aspiration nozzle and a control valve operable to connect the aspiration nozzle to the air feed line and disconnect it therefrom.

BRIEF DESCRIPTION OF THE DRAWINGS

The present invention will be further described in connection with a preferred embodiment thereof, with reference being had to the accompanying drawings, wherein.

DESCRIPTION OF THE PREFERRED EMBODIMENTS

Figure 1:
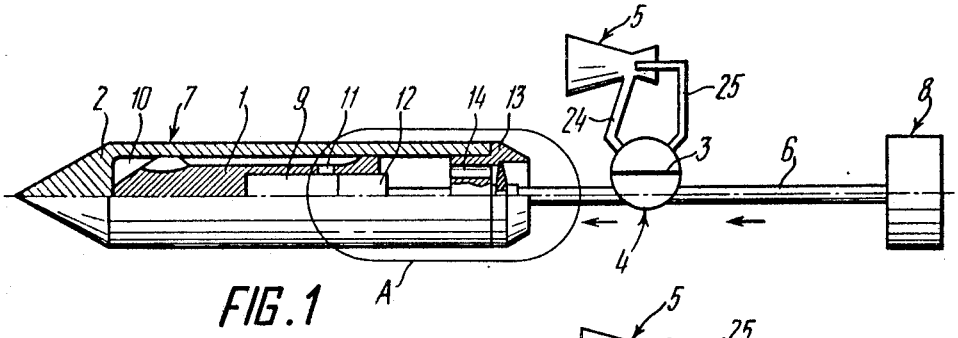
FIG. 1 schematically illustrates a system depicting the method of controlling the reversing of pneumatic percussive devices for making holes in the earth in accordance with the invention, in the forward mode of the operation of the device.

The method of controlling the reversing of a pneumatic reversible percussive device for making holes in the earth, in accordance with the invention, includes the operation of supplying compressed air from an external source into the air feed line and into the reversible device for making holes in the earth, as indicated with arrows in FIG. 1. To clarify the description of the method, some of the elements of the device performing this method will be referred to hereinbelow. In the forward mode of the operation, when a hole is driven or made in the earth, an impact member 1 accomodated in a housing 2 delivers successive impacts upon the frontmost part of the housing 2. The gate 3 of a control valve 4 is in a position whereat the aspiration nozzle 5 of an aspirating means is disconnected from an air feed line 6, so that the reversible percussive device 7 for making holes in the earth is connected via the air feed line 6 to a compressed air source 8.

Figure 2:
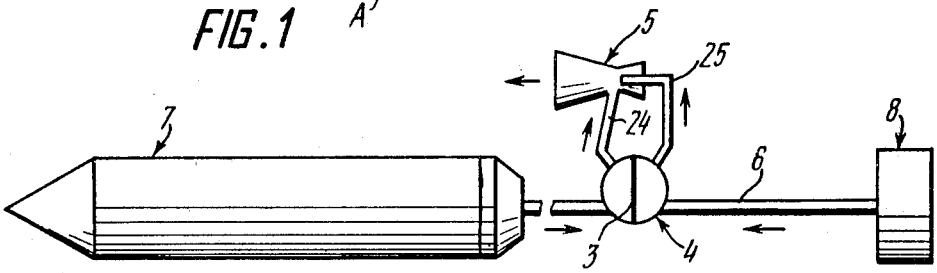
FIG. 2 shows the same, as FIG. 1, with the operation mode being reversed.

Should it be necessary to reverse the operation of the percussive device 7 for making holes in the earth, in accordance with the invention, the compressed air supply to the device 7 is cut off, e.g. by setting the gate 3 of the control valve vertically, as shown in FIG. 2, thus creating suction in the percussive action reversible device 7 for making holes in the earth by withdrawing air therefrom. This direction of the air flow in indicated with the arrow in FIG. 2. The suction thus created acts upon an element controlling the operation mode of the device 7, this element being displaced, switching over the device 7 to operation in the alternative mode, i.e. the reverse mode of operation.

It is deemed appropriate to illustrate the herein disclosed method of controlling the reversing of the device 7 by describing the operation of the reversible percussive device for making holes in the earth.

The pneumatic reversible percussive device 7 (FIG. 1) for driving or making holes in the earth, performing the herein disclosed reversing control method, includes the housing 2 in the form of a hollow cylinder with a pointed foremost or front end, i.e. the end which acts upon the soil to make a hole therein. The housing 2 accomodates therein the reciprocable impact member 1 having in the tail portion thereof a cylindrical space defining the rear working chamber 9. The external surface of the impact member 1 defines with the internal surface of the housing 2 the front working chamber 10. When the impact member 1 of the reversible device 7 for making holes in earth reciprocates, the working chambers 9 and 10 vary their volume. The front and rear working chambers 10 and 9 communicate via ports 11 made in the impact member 1.

The tail space of the impact member 1 receives therein a stepped-diameter bushing 12 (FIGS. 3 and 1) which is coaxial with the impact member 1, and, hence, with the housing 2, the bushing 12 having its greater-diameter portion or stage received in the hollow space of the impact member 1, while its smaller-diameter portion or stage is secured to the tail portion of the housing 2 by means of a nut 13 having an opening 14 therethrough for exhausting spent compressed air into an ambient medium such as the atmosphere. The stepped-diameter air supply bushing 12 has in the greater-diameter stage thereof ports 15 which are intended to supply compressed air from the rear working chamber 9 into the front working chamber 10 when the pneumatic reversible percussive device 7 for making holes in the earth is operated in the reverse mode.

Figure 3:
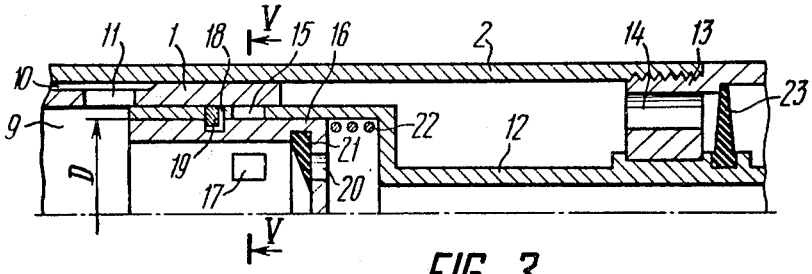
FIG. 3 is a longitudinal sectional view of the area A in FIG. 1 of the pneumatic reversible device for driving holes in earth, according to the invention.
Figure 4:
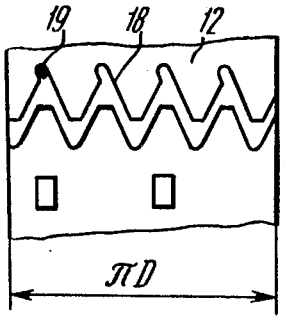
FIG. 4 shows an involute (rotated through 90°) of the external surface of the hollow valve element at the diameter D.

Received within the greater-diameter stage of the stepped-diameter air supply bushing 12 is a spring-urged hollow valve element 16 having in the surface thereof, cooperating with the air supply bushing 12, ports 17. These ports 17 are alignable with the ports 15 in the stepped-diameter air supply bushing 12 upon the hollow valve element 16 having been rotated accordingly about its longitudinal axis. The hollow valve element 16 has made in the cylindrical surface thereof, cooperating with the stepped-diameter air supply bushing 12, a zigzag-shaped groove 18 movably receiving therein a lug 19 fast with the greater-diameter portion or stage of the air supply bushing 12. FIG. 4 of the appended drawings shows an involute (rotated through 90°) of the external surface of the valve element 16 at the diameter D (FIG. 3). The end face of the hollow valve element 16, facing the smaller-diameter portion or stage of the air supply bushing 12, has made there-through apertures 20 associated with valves 21. The hollow valve element 16 is urged forwardly of the housing 2 by a compression spring 22. The stepped-diameter air supply bushing 12 carries a valve member 23 preventing ingress of soil into the reversible device 7.

The air feed line 6 incorporates an aspirator 5 with two conduits 24, 25 and a control valve 4 having a gate 3 rotatable between a horizontal position and a vertical one. In one of its positions (the horizontal one) the valve 4 connects the pneumatic reversible percussive device 7 for making holes in earth to the compressed air source 8, while in its other position, the vertical one, the reversible device 7 is connected to the suction conduit 24 of the aspirator 5, whereas the compressed air source is connected to the aspiration nozzle conduit 25 of the aspirator 5.

The aforedescribed pneumatic reversible percussive device 7 for making holes in the earth operates, as follows.

Figure 5:
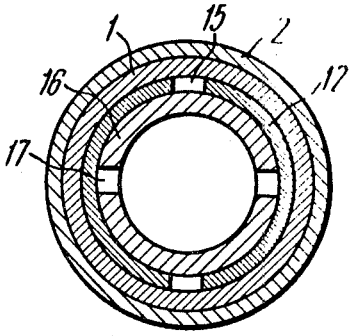
FIG. 5 is a sectional view taken on line V—V of FIG. 3 (with the ports of the bushing and the valve element driven apart)

To operate the pneumatic reversible percussive device 7 for making holes in earth in the forward, or hole-making mode, the gate 3 is turned into its horizontal position, and the reversible device 7 is connected to the compressed air source 8. Under the combined action of the spring 22 and compressed air the hollow valve element 16 is held in its foremost position. In this position the lug 19 of the stepped-diameter air supply bushing 12 sets at the peak or apex of the zigzag-shaped groove 18, facing the rear portion of the housing 2, and the ports 15 of the stepped-diameter air supply bushing 12 are closed with the wall of the hollow valve element 16, as shown in FIG. 5. Shown in FIG. 1 of the appended drawings is the foremost position of the impact member 1, whereat the impact member 1 strikes the housing 2 (which corresponds to the forward mode of operation of the reversible device 7 for making holes in earth).

When the air is supplied now via the feed line 6 into the rear working chamber 9, it is admitted into the front working chamber 10 through the ports 11 in the impact member 1. The pressure of the compressed air in the rear and front working chambers 9 and 10, respectively, being roughly equal, and the effective area of the end face surface of the impact member 1, acted upon by compressed air in the front working chamber 10, being greater than the effective face area of the same impact member 1, acted upon by compressed air in the rear working chamber 9, the efforts acting upon the impact member 1 from the front and rear working chambers 10 and 9, respectively, are different, the effort developed in the front working chamber 10 being greater. Consequently, the impact member 1 is being displaced toward the rear portion of the housing 2. Upon the ports 11 in the impact member 1 becoming closed off by the wall of the greater-diameter stage of the stepped-diameter air supply bushing 12, compressed air is no longer admitted into the front chamber 10. The volume of the latter increases, as the impact member continues its rearward motion, and the compressed air contained therein expands. Upon the ports 11 in the impact member 1 having cleared the rear face edge of the greater-diameter stage of the air supply bushing 12, the front working chamber 10 becomes connected to the ambient medium via the ports 11 in the impact member 1 and the openings 14 in the nut 13. The compressed air coming from the front working chamber 10 opens the valve 23 and escapes into the ambient medium, whereby the pressure in the working chamber 10 becomes roughly equal to atmospheric pressure, so that there is no longer an effort applied to the impact member 1 from the side of the front end of the housing 2. At the same time, from the side of the rear working chamber 9 continuously connected with the compressed air source 8 there acts upon the impact member 1 an effort developed by the action of compressed air upon the end surface of the impact member 1, facing the rear working chamber 9.

The last-mentioned effort, first, arrests the rearward motion of the impact member 1 and then drives it forwardly until its foremost end strikes the housing 2. Approximately at the same moment the ports 11 in the impact member 1 clear the foremost edge of the greater-diameter stage of the air supply bush 12, and compressed air is admitted into the front working chamber 10. The impact member 1 is driven rearwardly, and the abovedescribed cycle repeats itself.

To reverse the operation of the pneumatic reversible device 7 for making holes in earth, the gate 3 of the control valve 4 is turned into its vertical position.

The compressed air source 8 now supplies compressed air via the feed line 6 into the conduit 25 of the aspirator 5 where the dynamic head of the air stream is converted into a static sub-atmospheric pressure. This creates suction in the suction conduit 24 of the aspirator 5, and, hence, in the pneumatic reversible device 7 for making holes in earth. The air being withdrawn creates suction in the internal space of the stepped-diameter air supply bushing 12 of the reversible pneumatic device 7 for making holes in earth, and there is developed an air flow from the stepped-diameter air supply bushing 12 toward the aspirator 5. There is created a pressure drop between the rear working chamber 9 and the air in the internal space of the stepped-diameter air supply bushing 12. The gauge pressure of the air in the rear working chamber 9 drives the valve 21 of the hollow valve element 16 to the end wall of the latter, which precludes a flow of air from the rear working chamber 9 into the internal space of the stepped-diameter air supply bushing 12, through the port 20 of the hollow valve element 16. Under the action of the air from the rear working chamber 9 upon the end wall of the hollow valve element 16, the latter is driven rearwardly of the housing 2. While being thus axially displaced, this hollow valve element 16, owing to its operative connection with the stepped-diameter air supply bushing 12 with aid of the zigzag-shaped groove 18 in the surface of the valve element 16 and the lug 19 of the bushing 12, received therein, is rotated about its longitudinal axis through a specified angle. With the hollow valve element 16 having been thus driven into its rearmost position, the lug 19 of the air supply bushing 12 finds itself at the apex of the zigzag-shaped groove 18, facing the front portion of the housing 2.

Now, when the gate 3 of the control valve 4 is reset to its horizontal position, or else when no more suction is supplied to the reversible percussive device 7 for making holes in earth, the valve element 16 is returned by the spring 22 into its foremost position. While being thus displaced axially, the hollow valve element 16 is rotated through a certain angle about its longitudinal axis, owing to its operative connection with the stepped-diameter air supply bushing 12, because throughout this axial displacement of the hollow valve element 16 the lug 19 remains immobile, while the walls of the zigzag-shaped groove 18 of the hollow valve element 16 cooperate with this lug 19 and thus rotate the valve element 16. In the foremost position of the hollow valve element 16 the lug 19 finds itself in the rearmost blind end (although, the different one from the abovementioned) of the zigzag-shaped groove 18.

Figure 6:
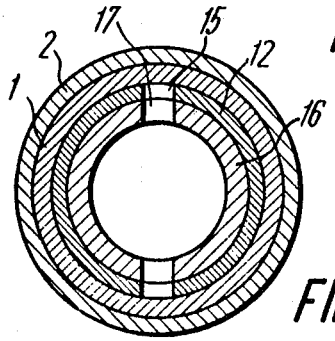
FIG. 6 is the same sectional view, as in FIG. 5, with the ports of the bushing and of the valve element aligned.

In this angular position of the hollow valve element 16, its ports 17 align with the ports 15 in the stepped-diameter air supply bushing 12, as shown in FIG. 6.

With compressed air now being fed from the supply source 8 via the feed line 6 (with the gate 3 of the valve 4 restored to its horizontal position, as shown in FIG. 1) into the percussive reversible device 7 for driving or making holes in earth, the impact member 1 is sent forward under the action of compressed air filling the rear working chamber 9, toward the front portion of the reversible device 7 for making holes in earth. Upon the ports 11 in the impact member 1 having established communication with the ports 15 in the greater-diameter stage of the stepped-diameter air supply bush 12, compressed air is admitted from the rear working chamber 9 through the ports 17, 15, respectively, of the hollow valve element 16 and the stepped-diameter air supply bushing 12 into the front working chamber 10. As it has been already stated, the effective area of the end surface of the impact member 1 in the front working chamber 10 is greater than that in the rear working chamber 9, and so the effort acting upon the impact member 1 from the front working chamber 10 is greater than that acting upon the same impact member 1 from the rear working chamber 9. This difference of the efforts starts slowing down the impact member 1. As the latter moves on forward, the ports 11 in the impact member 1 become closed off with the wall of the stepped-diameter air supply bushing 12, while the volume of the front working chamber 10 continues to diminish, whereby the air pressure is rapidly built therein. This built-up pressure increases still further the effort applied to the impact member 1 from the front working chamber 10. Under this effort the impact member 1 is arrested and starts moving rearwardly, and at the end of its rearward stroke it delivers an impact upon the tail portion of the housing 2, i.e. upon the nut 13, to be more precise. As a result of repeated impacts of this kind, the percussive reversible device for making holes in earth is driven backward, i.e. it is driven in the reverse mode of its operation. The ports in the impact member 1 clear the end edge of the greater-diameter stage of the air supply bushing 12, whereby the compressed air is exhausted from the front working chamber 10 into the ambient medium. Under the action of compressed air filling the rear working chamber 9 the impact member is sent forward once again, and the abovedescribed cycle of the reverse mode repeats itself.

Should it be necessary now to switch over the pneumatic reversible percussive device 7 from the reverse mode to the forward one, the sequence of switching it over from the forward to reverse mode is to be repeated, i.e. the gate 3 of the valve 4 is to be set to its vertical position, to create suction in the reversible device 7.

The hollow valve element 16 would be displaced into its rearmost position, while rotating through a certain angle about its longitudinal axis. Then the supply of suction is discontinued, and the hollow valve element 16 is restored into its original (i.e. the extreme foremost) position, whereat its wall closes of the ports 15 in the greater-diameter stage of the stepped-diameter air supply bushing 12.

What we claim is:

1. A method of controlling the reversing of a reversible percussive device in order to reverse the operation of the device from a forward mode for making a hole in soil to a reverse mode wherein the device is retracted from the hole and for returning the percussive device to the forward mode, the percussive device having a feed line for supplying the percussive device with compressed air, the method comprising shifting from the front mode to the reverse mode and vice versa by discontinuing supply of compressed air through the feed line, developing a suction in the device to effectively discontinue the mode in which the device is operating and establishing the other mode, and resupplying compressed air to the device through said feed line to drive the device in the selected other mode.

2. A reversible percussive device operable in a forward mode for making holes in the earth and in a reverse mode for extracting the device from the hole made in soil comprising, a hollow casing having a forward end having external surfaces for making a hole in the soil and a rear end for retracting the housing the housing from the hole, an impact member reciprocable in said housing defining jointly with said housing internally thereof a forward chamber and a rear chamber, means to supply compressed air to the rear chamber including a supply line connected thereto and means defining a passageway between the forward chamber and the rear chamber, control means including valve means on said supply line to control application of air pressure to said rear chamber for reciprocably driving said impact member to alternatively impact the forward end of the housing for driving the housing forwardly or the rear end of the housing for driving the housing rearwardly, and said control means including means responsive to the turning on and off of said valve means to disconnect said air pressure developing a suction on the device and resupplying compressed air for establishing a change of mode thereby to drive said impact member to alternatively impact the forward end and the rear end of said housing when said valve means is operated to effect a change of mode.

3. A reversible percussive device operable in a forward mode for making holes in the earth and in a reverse mode for extracting the device from the hole made in soil according to claim 2, in which said control means comprises an aspirator under control of said valve means for applying a suction to said supply line thereby to affect a change over of mode.

* * * * *